US009957105B2

(12) United States Patent
Germanow et al.

(10) Patent No.: US 9,957,105 B2
(45) **Date of Patent: *May 1, 2018**

(54) LINER BAG FOR FEMININE HYGIENE WASTE RECEPTACLES

(71) Applicant: THE SCENSIBLE SOURCE CO., LLC, Pittsford, NY (US)

(72) Inventors: John W. Germanow, Pittsford, NY (US); Ann D. Germanow, Pittsford, NY (US)

(73) Assignee: THE SCENSIBLE SOURCE CO., LLC, Rochester, NY (US)

( * ) Notice: Subject to any disclaimer, the term of this patent is extended or adjusted under 35 U.S.C. 154(b) by 52 days.

This patent is subject to a terminal disclaimer.

(21) Appl. No.: 14/219,959

(22) Filed: Mar. 19, 2014

(65) Prior Publication Data

US 2014/0205212 A1 Jul. 24, 2014

Related U.S. Application Data

(63) Continuation of application No. 12/082,537, filed on Apr. 11, 2008, now Pat. No. 8,690,429.

(Continued)

(51) Int. Cl.
*B65F 1/04* (2006.01)
*B65F 1/06* (2006.01)

(Continued)

(52) U.S. Cl.
CPC ..... *B65F 1/0006* (2013.01); *B65F 1/002* (2013.01); *B65F 1/0026* (2013.01); *B65F 1/04* (2013.01); *B65F 1/06* (2013.01); *B65F 2240/164* (2013.01)

(58) Field of Classification Search
CPC ..... B65F 1/00; B65F 1/0006; B65F 1/0013; B65F 1/002; B65F 1/04; B65F 1/06;

(Continued)

(56) References Cited

U.S. PATENT DOCUMENTS 1,808,375 A 6/1931 Plooster
2,866,980 A * 1/1959 Huntington ..... A47K 11/04 4/484

(Continued)

FOREIGN PATENT DOCUMENTS

EP 1013567 6/2000
WO WO2007/050928 5/2007

OTHER PUBLICATIONS

Sanitary Disposal Unit, Website printouts from www.sdunit.com (2004).

(Continued)

*Primary Examiner* — Jes F Pascua
*Assistant Examiner* — Nina Attel
(74) *Attorney, Agent, or Firm* — Lukacher Law Group; Kenneth J. Lukacher

(57) ABSTRACT

An improved receptacle liner bag is formed of two layers of thin flexible stretchable plastic sheets which are sealed along the sides and bottom, but are unsealed along the top of the bag. The sheets are die-cut to form a framed opening which defines a band between the sides and the top of the bag. When the bag is placed in the receptacle, the band may be disposed around the outside of the sides of the receptacle and stretched over the base of the receptacle so as to provide a hold-down for the bag in the receptacle. The sheets may be perforated along a line below the framed opening. The line, when opened, forms an auxiliary band which can be stretched over and placed behind a hinge of a lid of the receptacle to secure the back of the liner bag in the receptacle.

24 Claims, 9 Drawing Sheets

Related U.S. Application Data

(60) Provisional application No. 60/922,790, filed on Apr. 11, 2007.

(51) Int. Cl.
*B65D 33/06* (2006.01)
*B65D 33/10* (2006.01)
*B65F 1/00* (2006.01)

(58) Field of Classification Search
CPC ..... B65F 1/065; B65F 1/068; B65F 1/141; B65F 1/1415; B65F 2001/061; B65F 2220/112; B65F 2240/164
USPC ..... 4/480, 484; 220/495.01, 495.02, 220/495.06–495.11, 9.4, 476, 480, 483, 220/560; 217/3 R
See application file for complete search history.

(56) References Cited

U.S. PATENT DOCUMENTS 3,349,936 A 10/1967 Morton et al.
3,580,486 A 5/1971 Kugler
3,664,622 A * 5/1972 Vaccaro ..... B65F 1/06 211/88.01
3,774,838 A 11/1973 Christie
3,822,806 A 7/1974 Grimes
4,017,020 A 4/1977 Frank
4,753,538 A 6/1988 Jorda
4,867,339 A 9/1989 Hahn
5,105,969 A 4/1992 Lamas
5,155,871 A 10/1992 Sams
5,261,553 A 11/1993 Mueller et al.
5,394,834 A 3/1995 Queen et al.
5,462,103 A 10/1995 Effa
6,115,855 A 9/2000 Lorenzo
6,123,215 A 9/2000 Windle
6,375,131 B1 4/2002 Youst
6,398,411 B2 6/2002 Metzger
6,457,863 B1 10/2002 Vassallo
6,517,033 B2 2/2003 Russell et al.
6,739,114 B2 5/2004 Shaffer
7,210,848 B2 5/2007 Barbier et al.
D545,215 S 6/2007 Germanow et al.
8,282,280 B2 10/2012 Germanow et al.
2003/0089719 A1 5/2003 Berger
2003/0136787 A1 7/2003 Singuillo
2005/0069227 A1 3/2005 Steele
2006/0163257 A1 7/2006 Golbert
2007/0116384 A1 5/2007 Mason
2007/0163038 A1 7/2007 Sharp
2007/0189643 A1 8/2007 Tresenfeld
2008/0006638 A1* 1/2008 Yang ..... B65F 1/06 220/495.11
2008/0154221 A1 6/2008 Thornton

OTHER PUBLICATIONS

Ruffles Retail Trash Bags, Covalence Plastics Co. Web page at http://www.covalenceplastics.com/site/content/retail/retail.asp (2006).
Intima & Intima Mini, Kennedy Hygiene Products Ltd., printout from http://www.kennedy-hygiene.co.uk/productrange/femininehygiene/intima.html (2004).
6140 Sanitary Napkin Recepticle, Rubbermaid Commercial Products, printout from http://www.rcpworksmarter.com/rcp/products/detail.jsp?categoryCode=c- leaning&subCategoryCode=cleaning.sub.—washroom&rcpNum=6140 (2008).
Health Gards.RTM. Liners, Hospeco, Printout from http://www.hospeco.com/instit/liners.asp, dated Aug. 20, 2008.
Disposal Units & Liners, Rochester Midland Corporation, Printout from http://www.rochestermidland.com/division/perscare/feminine/units.sub.—an- d.sub.—liners.htm (2000).
Intima, Product Specification Sheet, Kennedy Hygiene Products, Ltd. ( 2004).

* cited by examiner

LINER BAG FOR FEMININE HYGIENE WASTE RECEPTACLES

This application is a continuation of U.S. patent application Ser. No. 12/082,537, filed Apr. 11, 2008, now U.S. Pat. No. 8,690,429, which claims priority to U.S. Provisional Patent Application No. 60/922,790, filed Apr. 11, 2007, which is herein incorporated by reference.

FIELD OF THE INVENTION

The present invention relates to apparatus (and method) for the sanitary disposal of feminine hygiene products after use thereof, and particularly to a liner bag for feminine hygiene waste receptacles which receive such products.

BACKGROUND OF THE INVENTION

Women's restrooms are equipped with waste receptacles for sanitary napkins and other feminine hygiene products. These receptacles are boxes of metal or plastic having a lid provided by a cover. The back of the receptacle is attached to a wall of the stall. The lid is hinged to the back wall of the receptacle. Sides of the lid may form a skirt which extends over the top of the receptacle and the front and the sides thereof. These receptacles receive a bag therein and may be called surface mounted sanitary napkin disposal units.

Heretofore waxed bags, which may be of waxed paper, were inserted into the receptacle. These bags are prone to being pushed down into the receptacle as the bags are filled with the feminine hygiene products. The sides of the bag may become displaced from the insides of the receptacle or may be pushed down into the receptacle. When this occurs, the feminine products may fall between the outside of the bag and the inside walls of the receptacle, or are placed against the unprotected walls of the receptacle. This creates unsanitary conditions, since the waxed paper bag, when pushed down into the receptacle or away from the walls thereof, loses its effectiveness as a sanitary container.

SUMMARY OF THE INVENTION

Accordingly, it is an object of the present invention to provide an improved apparatus and method which facilitates the disposal of sanitary products, such as sanitary napkins and other feminine hygiene products.

It is another object of the present invention to provide liner bags which fit within a receptacle and are secured alongside the inner walls thereof to prevent the sanitary products which are inserted therein from falling between the inner walls of the receptacle and the bag.

It is a further object of the present invention to provide an improved liner bag for feminine hygiene waste receptacles, which when installed in the receptacle define a stretchable wrapping band which loops around the receptacle over the base thereof to hold the bag securely in the receptacle.

It is a still further object of the present invention to provide a liner bag for feminine hygiene waste receptacles having a lid where the bag forms an auxiliary band which extends over the lid and against an area, where the lid joins and may be hinged to a back wall of the receptacle for securing the bag against the inside back wall of the receptacle.

Briefly described, the invention provides an improved receptacle liner bag, especially suitable for surface mounted sanitary napkin disposal units. The bag is formed of two layers of thin flexible, stretchable plastic sheets which are sealed along the sides and bottom, but are unsealed along the top of the bag. The sheets are die-cut to form a framed opening which defines a band between the sides and the top of the bag. Since the bag is made of flexible stretchable plastic material, the band along the sides and top of the framed opening can be stretched around the receptacle. Accordingly, when the bag is placed in the receptacle, the band may be disposed around the outside of the sides of the receptacle and stretched over the base of the receptacle so as to provide a hold-down for the bag in the receptacle. The bag may not only line the receptacle, but also provide a flap or skirt which extends over the side and front walls of the receptacle. The flap and the hold-down prevent any used feminine hygiene product which may be placed into the bag from pushing the bag away from the insides of the walls of the receptacle and enter between the receptacle and the bag. The liner bag is therefore an efficient and effective sanitary napkin and other feminine hygiene product disposal device.

In a preferred embodiment of the invention, the sheets are slit along a line below the bottom of the frame forming opening. This slit may be provided by a line of perforations. The slit defines an auxiliary band between the bottom of the opening and the line of perforations. This auxiliary band is placed behind the lid of the receptacle by passing the lid through the slit, provided by the perforations. This band is stretchable to secure the bag against the back wall of the receptacle which is mounted on the wall of the stall or toilet room.

The invention also provides a method for installing a liner bag in a receptacle having the steps of: providing a bag of flexible material having a first end which is closed and a second end having an opening that forms a band; locating the bag in a receptacle having a bottom, and stretching the band to loop around the bottom exterior of the receptacle to retain the bag upright in the receptacle. The locating step may extend flaps over the rim of the receptacle, in which the bag provides such flaps along the bottom of the opening that forms the band. The method may further have the step of locating a second band around the lid of the receptacle, in which the bag has another opening at its first end providing such second band.

The foregoing and other objects features and advantages of the invention as well as a presently preferred embodiment thereof will become apparent from the accompanying drawings.

DETAILED DESCRIPTION OF THE INVENTION

Figure 1:
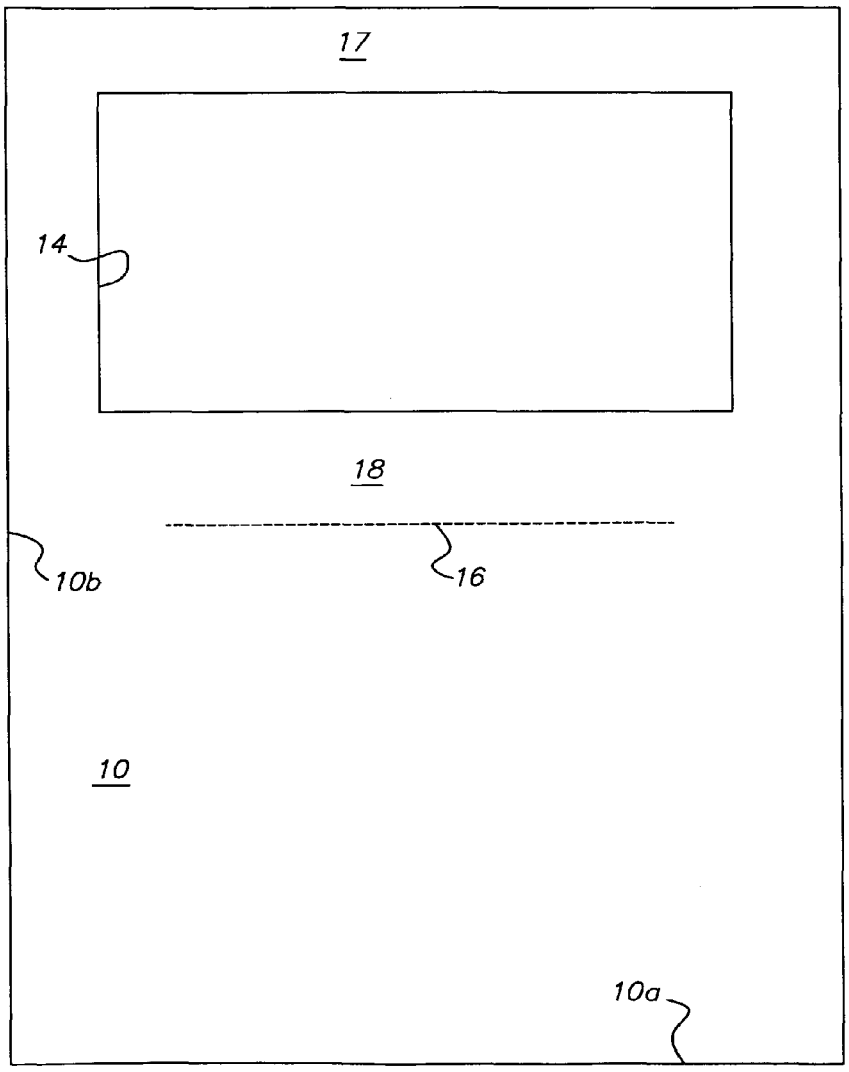
FIG. 1 is a plan view of a liner bag provided in accordance with the invention which is especially adapted to provide a disposable bag into which used feminine hygiene products are received when the bag is inserted into a receptacle, and especially a receptacle of a surface mounted sanitary napkin disposal unit.

Referring to the drawing, the bag (10) itself is a plastic bag or container (see FIG. 1) preferably of low density, 1 mil. thick low density polyethylene material. Bag (10) is formed of two layers of thin flexible stretchable plastic sheets which are sealed along the sides and bottom to provide a closed end (10*a*), and unsealed along a length of a top end (10*b*). The bag is long enough to fill the receptacle (12) to the bottom thereof. The bag (10) is, by virtue of the material thereof flexible and stretchable, facilitates insertion thereof into the receptacle with a flap (15) or skirt extending around the top of the receptacle (see FIGS. 2 A-D). In order to form the band (17) which holds the bag (10) inside the receptacle and also to form the flap, the bag is made longer than the side walls of the receptacle. For example, the receptacle may be 10" in height above the base and have an opening 8" long and 4" wide. In other words, the depth of the receptacle, from the front wall to the back wall thereof which is mounted on the wall of the stall, is 4", approximately. The bag is provided (by die-cutting the sheets forming such bag) with a die-cut opening (14) providing a frame which forms the band (17) around the sides and top of the opening. The top of the opening is the top of the band. The opening is of a size sufficient to leave an area for the flap below the bottom of the opening. For example, for a 10" high receptacle, the frame around the sides and top of the opening may be an inch and a half in width and the bottom of the opening may be 14" above the bottom of the bag. This leaves an area sufficient to form the flap.

Figure 4A:
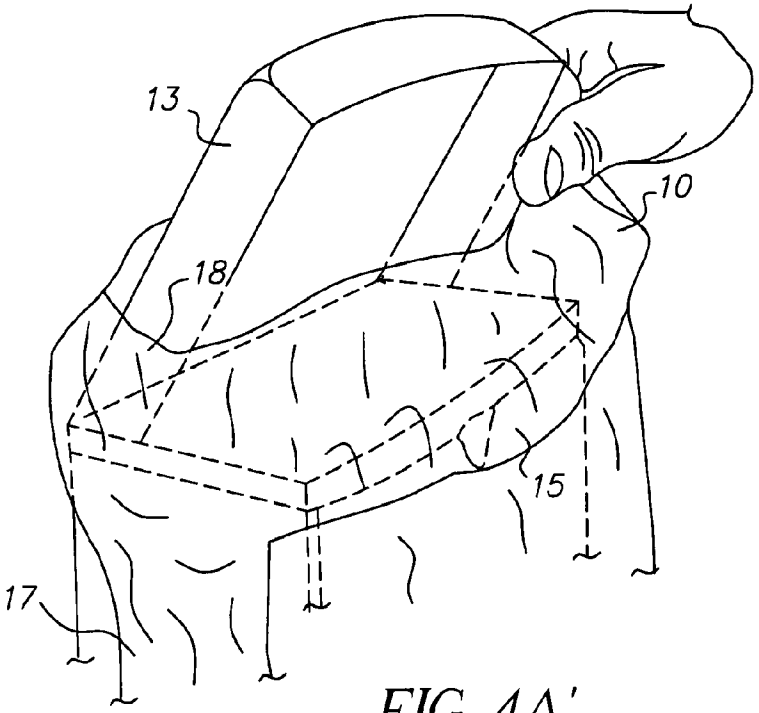
FIGS. 4A, 4A', 4B, 4B', 4C, and 4D are perspective views showing the liner bag provided by the invention in the process of installation into a receptacle and showing the auxiliary band formed when the liner perforations are opened to provide a slit, installed partially across the lid and the loop of the band which stretches around the sides and over the bottom of the receptacle lying across the sides and face of the receptacle, FIG. 4A and A' being taken from the left side, FIGS. 4B and 4B' being taken from the right side, FIG. 4C being taken from the back with the lid being pivoted on the hinge, which attaches the lid to the back of the receptacle, in a partially open position to show the auxiliary band being stretched across the lid toward the joint formed by the hinge, and with FIG. 4D being taken from the front of the receptacle with the lid opened and the auxiliary band being pushed over the lid.
Figure 4A:
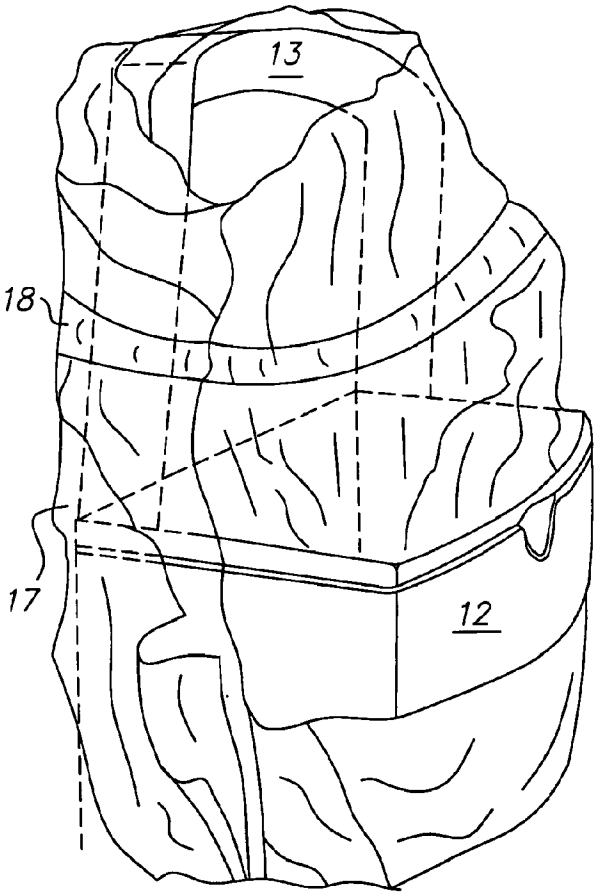
Figure 4B:
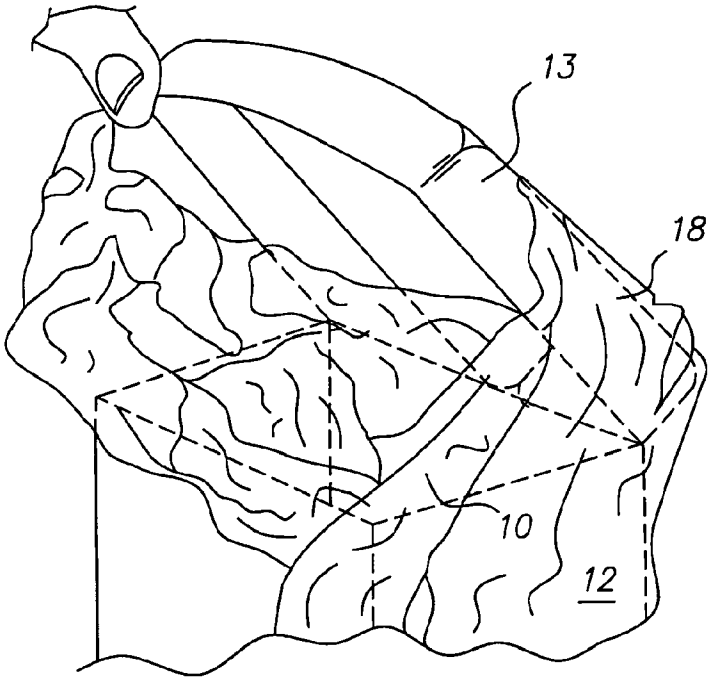
Figure 4B:
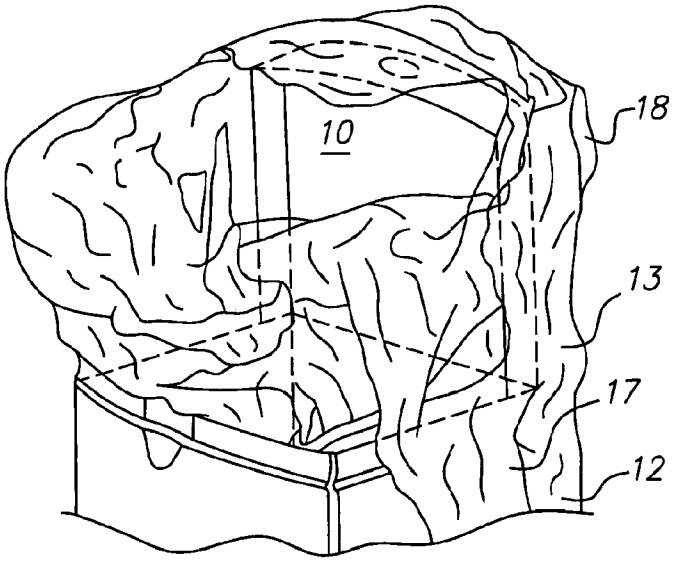
Figure 4D:
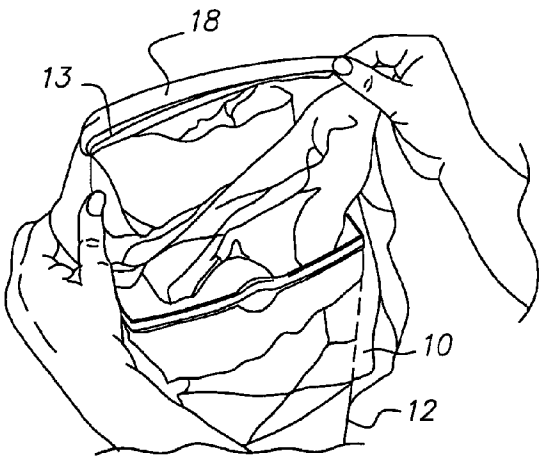
Figure 4C:
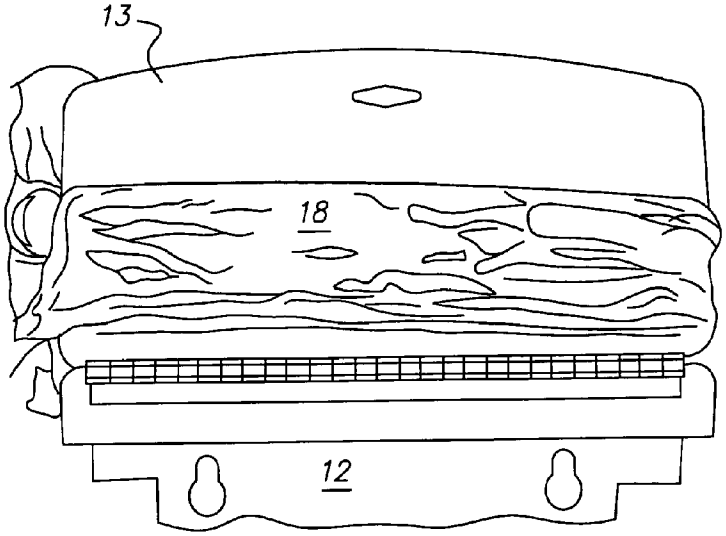

In order to form an auxiliary band (18), which extends over and behind the lid (13) of the receptacle (12) and secures the back of the inserted bag (10) inside the receptacle and further eliminates any space between the edge of the back of the bag and the inside back wall of the receptacle, a slit is formed by a line of perforations (16). This slit defines, between the bottom of the opening (14) and the line (16), an auxiliary band (18). This auxiliary band (18) is formed when the perforations are opened to provide the slit upon insertion of the band (18) onto the lid (13) of the receptacle (12) as best shown in FIGS. 4A, B, C and D. The use of this auxiliary band (18) is preferred but is optional. The slit formed by the line of perforations (16) and the auxiliary band (18) formed when the perforations are opened to provide the slit upon insertion of the band (18) into the lid (13) of the receptacle (12) provides means for extending another band from one of the ends which loops around the lid.

Figure 2A:
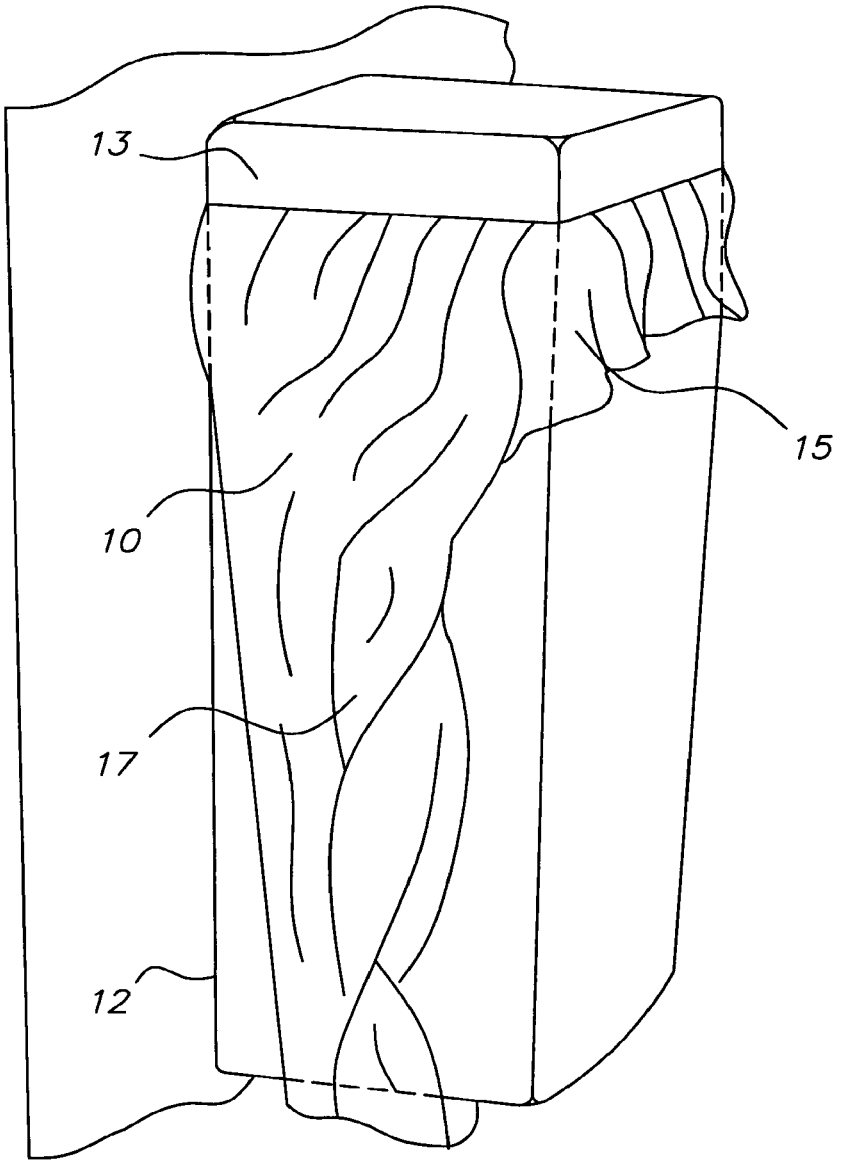
FIGS. 2A, 2B, 2C, and 2D are respectively perspective views from the left side, the right side, the back (with the lid of the receptacle closed), and from the bottom of a surface mounted disposal unit wherein the liner bag provided in accordance with the invention is installed into the receptacle of the surface mounted unit.
Figure 2B:
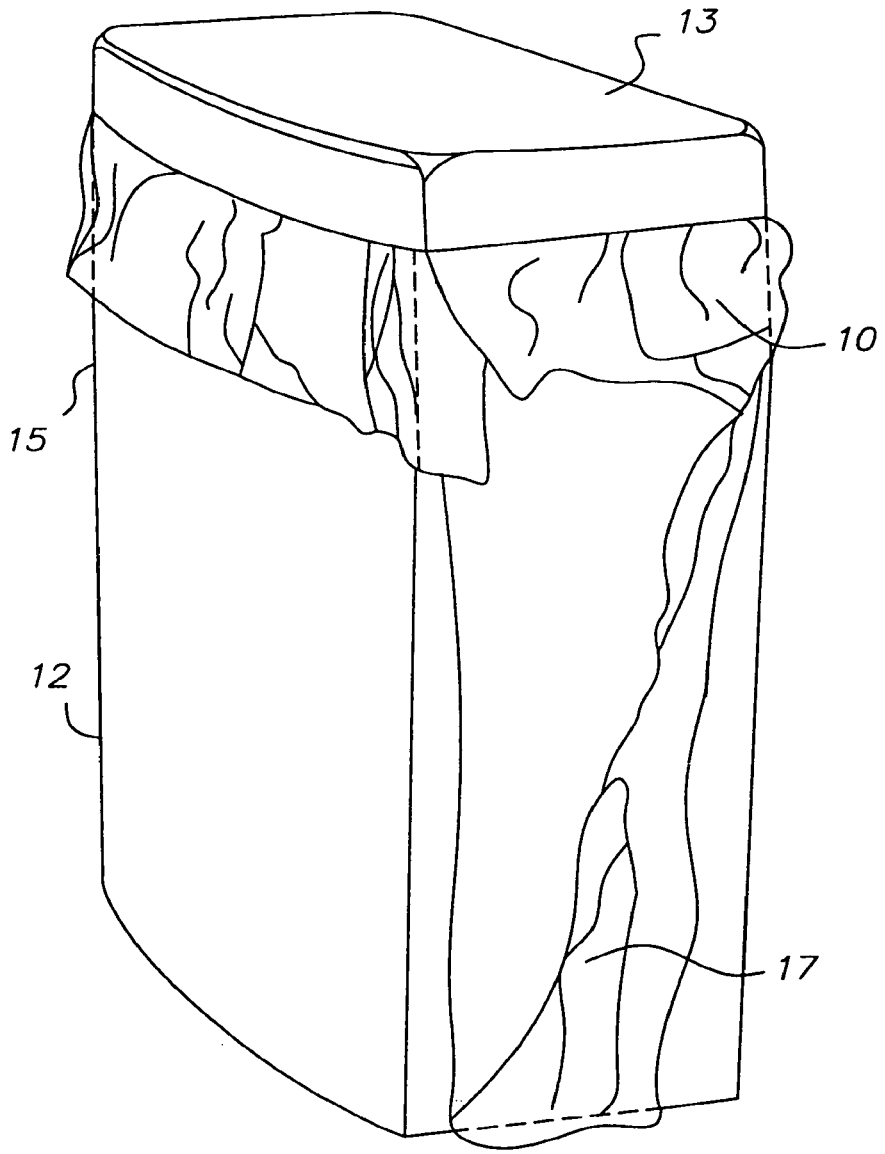
Figure 2D:
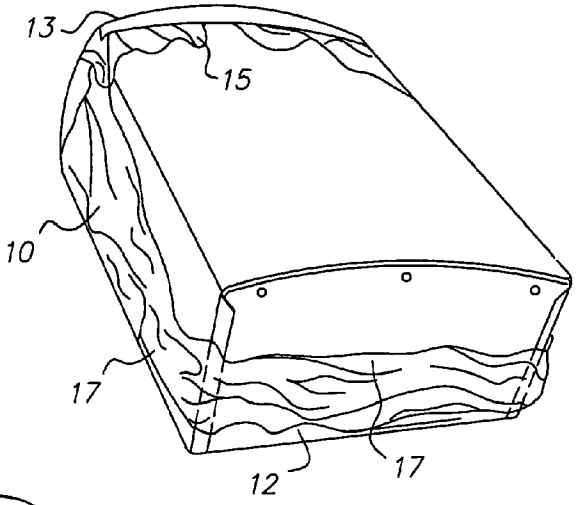
Figure 2C:
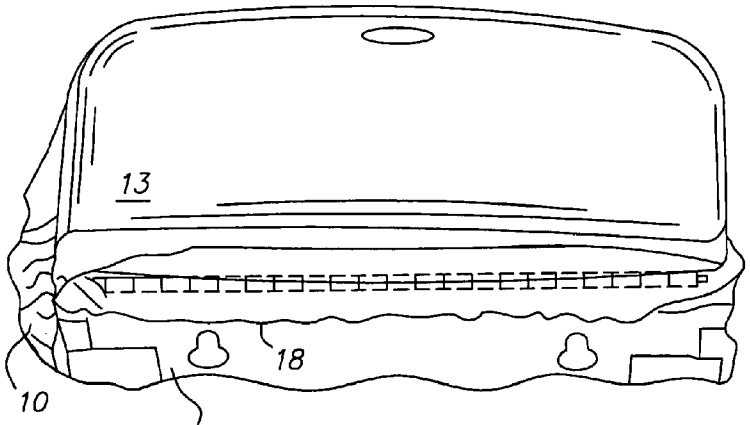
Figure 2F:
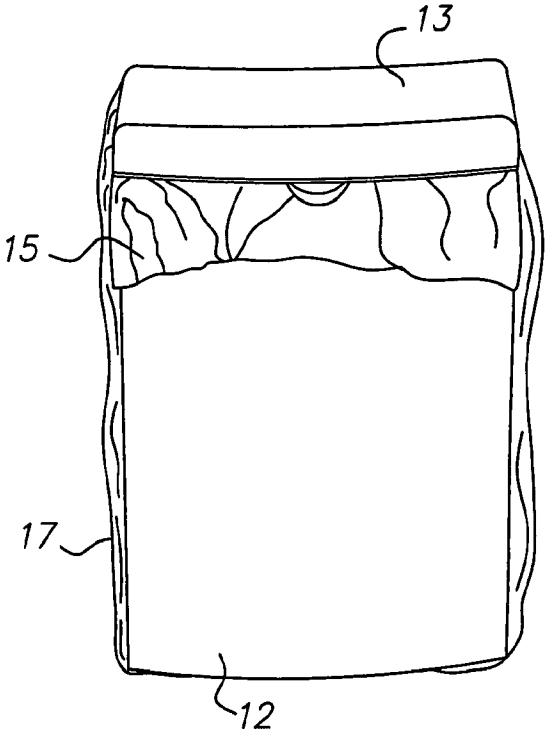
FIG. 2F is a perspective view from the front showing the bag installed in the receptacle with the lid closed.
Figure 2E:
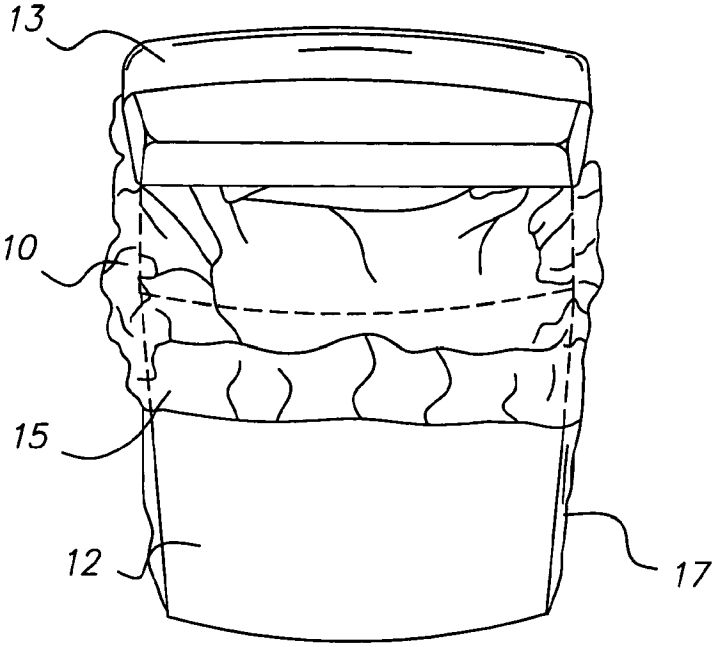
FIG. 2E is a perspective view from the front with the lid open showing the bag installed in the receptacle.
Figure 3A:
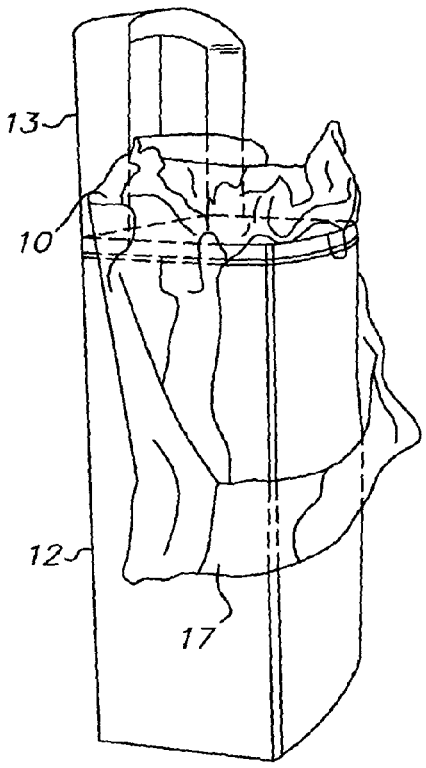
FIGS. 3A and 3B are perspective views of the surface mounted unit receptacle with the liner bag provided by the invention in process of being installed, and specifically at the stage where the bag is partially inserted into the receptacle of the unit, FIG. 3A being from the left side and FIG. 3B from the right side of the unit respectively.
Figure 3B:
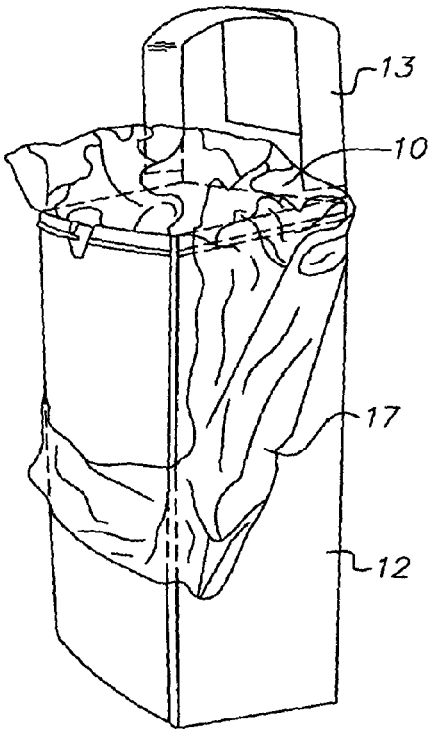

When the bag (10) is inserted into the receptacle (see FIGS. 3 and 4), the backside of the flap bears against the inside back wall of the housing. The band (17) which is formed along the outsides of the opening and along the top of the opening, which may, in the above example, be approximately 1½" in width and can be extended over the top edge of the receptacle while the flap is formed over the front wall and the side walls of the receptacle. The band (17) is long enough to be brought around the sides of the receptacle (12) and loops around the base of the receptacle so that it can stretch and provide a tight fit, thereby retaining the bag and its flaps in the receptacle. The flexible, stretchable material of the bag (10) allows the band (17) to be stretched along the outside, side walls of the receptacle (12) and to loop around and bear against the base of the receptacle. As the bag (10) is filled with sanitary napkin and other feminine hygiene product waste, the bag thus maintains its installed position (e.g., upright) in the receptacle (12). Accordingly, the bag (10) opening and the configuration and size of the band (17) formed by the opening in the bag provide means for extending the band from one of the ends of the bag which is configured and sized with respect to the receptacle to loop around and bear entirely against the bottom exterior of the receptacle to retain position of the bag with respect to the receptacle when the other of the ends of the bag is located in the receptacle. Also, band (17) as shown in FIG. 2D not only is under the bottom of the receptacle (12) extending between the receptacle's left and right side walls, but by virtue of the bag (10) lining the receptacle (12) a portion of band (17) that lies under the bottom of the receptacle (12) also is disposed under the closed bottom of the bag (10).

Preferably, the plastic material of the bag (10) includes bio-degradable plastic additive which enables the bag to bio-degrade when disposed of in a sanitary landfill.

Preferably, the bag material contains an antimicrobial agent which inhibits the growth of odor causing bacteria.

The bag material may contain fragrance materials to mask odors and can also provide a fresh floral smell. The bag (10) may be made with or without bio-degradable plastic additive and with or without antimicrobial or fragrance agents.

Another feature of the invention is that the band (17) and auxiliary band (18) facilitate the removal of the bag (10) after it is full, so that the bag may be disposed of together with the used feminine hygiene products contained therein. The band (17) may be slipped off the bottom of the receptacle (12) and the auxiliary band (18), if present, may be slipped off around the lid (13). Then the bag (10) may be lifted out of the receptacle (12) with the aid of the band (17) and the auxiliary band (18). The band (17) may be tied into a knot or with a tie, to close the bag (10) and prevent the used feminine hygiene products from falling out of the bag after it is removed from the receptacle (12). Thus, the band (17) is configured and sized to provide means which utilizes the band to close and retain contained waste in the bag when the bag is removed from the receptacle (12).

From the foregoing description, it will be apparent that an improved receptacle liner bag and method for using such bag has been provided. Variations and modifications of the herein described receptacle liner bag and other applications for the invention will undoubtedly suggest themselves to those skilled in the art. Accordingly, the foregoing description should be taken as illustrative and not in a limiting sense.

The invention claimed is:

1. An apparatus comprising:

a container of stretchable thin material having a closed bottom end and an open top end, in which said open top end has two opposing sides;

a receptacle having a closed bottom;

a band having two ends each extending from a different one of said two opposing sides of said open top end, and said band being formed from a portion of said material from said two opposing sides across said open top end, in which said band is configured to fit under said closed bottom of said receptacle when stretched downwards to locate said band along an exterior of both left and right sides of the receptacle and under the closed bottom of the receptacle extending between said left and right sides during installation of the container, via a top rim of the receptacle, as a liner for the receptacle with the closed bottom end of the container being disposed above said closed bottom of the receptacle; and a skirt or flap along the open top end configured to extend over the top rim of the receptacle during the installation of the container as the liner for the receptacle, in which said two ends of said band are each continuous with the skirt or flap extended over the rim, and said two ends of said band being configured to dispose said two ends of said band below said top rim each along the exterior of a different one of said left and right sides of the receptacle.

2. The apparatus according to claim 1 wherein said open top end of said container is of sufficient length from said closed bottom end of the container to define said skirt or flap.

3. The apparatus according to claim 1 wherein the band is sufficiently long to be knotted upon removal of the container from the receptacle filled with feminine hygiene waste.

4. The apparatus according to claim 1 wherein said container is of biodegradable material.

5. The apparatus according to claim 1 wherein said container is of material having an antimicrobial agent.

6. The apparatus according to claim 1 wherein said container is of scented material.

7. The apparatus according to claim 1 wherein said band is configured to tightly fit under the closed bottom of the receptacle to retain said container upright when said container is installed as the liner in said receptacle.

8. The apparatus according to claim 1 wherein said band provide means for lifting said container with said feminine hygiene waste contained therein from the receptacle when said band is slipped off from being stretched around the closed bottom of the receptacle.

9. The apparatus according to claim 8 wherein said container is closed by said band being tied into a knot or with a tie to prevent feminine hygiene waste contained therein from falling out of the bag when removed from the receptacle.

10. The apparatus according to claim 1 wherein said band consists of a single band of two layers of said material.

11. The apparatus according to claim 1 wherein a portion of said band is located under the closed bottom end of the container, and said container is positioned in an upright state for receiving waste items via said open top end.

12. The apparatus according to claim 11 wherein said portion of said band is further disposed under the closed bottom of the receptacle with said container configured in said upright state as the liner for the receptacle.

13. A method for installing a liner bag in a receptacle comprising the steps of:

providing a bag of flexible material having a first end which is closed and a second end having an opening that forms a band of a length selected exclusively for use of said band to fit under a closed bottom of the receptacle;

locating said bag in the receptacle so that the bag lines the receptacle and the first end of the bag is disposed above said closed bottom; and stretching said band to tightly fit around an exterior of both left and right sides of the receptacle and the closed bottom of said receptacle extending between said left and right sides to retain said bag upright in the receptacle.

14. The method according to claim 13 wherein said receptacle has a rim, and said method further comprises extending said bag over said rim so that said bag provides flaps along a bottom of said opening, and said locating step further comprises extending the flaps over the rim of the receptacle.

15. The method according to claim 13 further comprising the step of locating a portion of the bag over a rim of the receptacle when said bag is located in the receptacle.

16. The method according to claim 13 wherein said bag is of material which is one or more of biodegradable, antimicrobial, or scented.

17. The method according to claim 13 further comprising the steps of slipping said band from the bottom of the receptacle, and utilizing said band to lift said bag with said feminine hygiene waste contained therein from the receptacle.

18. The method according to claim 17 further comprising the step of closing said bag with said band being tied into a knot or with a tie to prevent feminine hygiene waste from falling out of the bag.

19. A waste disposal unit having a liner comprising:

a receptacle having an upper opening with a rim, a closed bottom, and left and right sides extending between said upper opening and said closed bottom, and a lid over said rim to open and close said receptacle;

a bag having a lower contents receiving portion with a closed bottom end, and an upper band forming a loop with two ends connected to said lower contents receiving portion, and a skirt or flap along a top of the lower contents receiving portion, in which said lower contents receiving portion of said bag is located in said receptacle with said skirt or flap extending over the rim of said receptacle with the closed bottom end of the bag being disposed above said closed bottom of the receptacle, and said band is stretched downwards to locate said band along an exterior of both said left and right sides of the receptacle and under the closed bottom of said receptacle extending between said left and right sides;

said band is of a length selected to enable said band when stretched to tightly fit under said closed bottom of the receptacle to retain said bag upright in the receptacle with contents being received in said lower contents receiving portion; and said two ends of said band are each continuous with the skirt or flap extended over the rim to dispose said two ends of said band below said rim each along the exterior of a different one of said left and right sides of the receptacle.

20. The waste disposal unit according to claim 19 wherein said band enables manual lifting of said lower content receiving portion of said bag with said contents contained therein from the receptacle when said band is slipped off from being stretched under the closed bottom of the receptacle.

21. The waste disposal unit according to claim 19 wherein said band is a single band of two layers of material, said band being positioned downwards along said left and right sides of the receptacle to traverse under an entire extent of the closed bottom of said receptacle which extends between said left and right sides of the receptacle, and said lid extends over said bag when said lid closes said receptacle.

22. A waste disposal unit comprising:

a receptacle; and a liner bag comprising:

a container of stretchable thin material having a closed bottom end and an open top end, in which said top end has two opposing sides; and a band having two ends each extending from a different one of said two opposing sides of said open top end, and said band being formed from a portion of said material extending from said two opposing sides across said top end, in which said band fits under a closed bottom of said receptacle when stretched downwards to locate said band along an exterior of both left and right sides of the receptacle and under the closed bottom of said receptacle extending between said left and right sides during installation of the liner bag, via a top rim of the receptacle, as a liner for the receptacle with the closed bottom end of the container being disposed above said closed bottom of the receptacle.

23. The waste disposal unit according to claim 22 wherein said band is of a length selected to locate said band along the exterior of both left and right sides of the receptacle and under the closed bottom of said receptacle during installation of the liner bag in said receptacle.

24. The waste disposal unit according to claim 22 wherein said band enables manual lifting of said container with feminine hygiene waste contained therein from the receptacle when said band is slipped off from being stretched around the closed bottom of the receptacle.

* * * * *